US010618764B2

(12) United States Patent
Shimamura et al.

(10) Patent No.: US 10,618,764 B2
(45) Date of Patent: Apr. 14, 2020

(54) PAPER SHEET ACCOMMODATION APPARATUS AND METHOD OF CONTROLLING PAPER SHEET ACCOMMODATION APPARATUS

(71) Applicant: FUJITSU FRONTECH LIMITED, Inagi (JP)

(72) Inventors: Tatsuya Shimamura, Inagi (JP); Hayato Minamishin, Inagi (JP); Yutaka Namikawa, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 16/185,507

(22) Filed: Nov. 9, 2018

(65) Prior Publication Data

US 2019/0080544 A1 Mar. 14, 2019

Related U.S. Application Data

(63) Continuation of application No. PCT/JP2016/065816, filed on May 27, 2016.

(51) Int. Cl.
*B65H 29/51* (2006.01)
*B65H 5/28* (2006.01)
(Continued)

(52) U.S. Cl.
CPC ..... *B65H 29/006* (2013.01); *B65H 5/28* (2013.01); *B65H 7/06* (2013.01); *B65H 29/51* (2013.01);
(Continued)

(58) Field of Classification Search
CPC ..... B65H 5/28; B65H 29/006; B65H 29/51; B65H 2301/41912
See application file for complete search history.

(56) References Cited

U.S. PATENT DOCUMENTS 6,585,098 B2 * 7/2003 Satou ..... B65H 29/006 194/206
7,469,822 B2 * 12/2008 Razzaboni ..... B65H 29/006 235/379
(Continued)

FOREIGN PATENT DOCUMENTS

JP 2000-123219 4/2000
JP 2001-122470 5/2001
(Continued)

OTHER PUBLICATIONS

International Search Report dated Jul. 12, 2016 in corresponding International Patent Application No. PCT/JP2016/065816.
(Continued)

*Primary Examiner* — Luis A Gonzalez
(74) *Attorney, Agent, or Firm* — Staas & Halsey LLP

(57) ABSTRACT

A paper sheet accommodation apparatus includes: a supply reel which supplies a wound band-like material; a winding drum around which a paper sheet is wound together with the band-like material supplied from the supply reel; a taking in and out section through which the paper sheet is taken in and out; and a rotating shaft that is disposed in the taking in and out section, is rotatably provided with a pulley that supports the band-like material, and has a transport roller fixed thereto, which transports the paper sheet.

7 Claims, 7 Drawing Sheets

(51) Int. Cl.

| | |
|---|---|
| ***B65H 29/00*** | (2006.01) |
| ***B65H 7/06*** | (2006.01) |
| ***G07D 11/12*** | (2019.01) |
| ***G07D 11/13*** | (2019.01) |
| ***G07D 11/16*** | (2019.01) |

(52) U.S. Cl.

CPC ..... *G07D 11/12* (2019.01); *G07D 11/13* (2019.01); *G07D 11/16* (2019.01); *B65H 2301/41912* (2013.01); *B65H 2511/51* (2013.01); *B65H 2511/515* (2013.01); *B65H 2511/528* (2013.01); *B65H 2513/41* (2013.01); *B65H 2701/1912* (2013.01)

(56) References Cited

U.S. PATENT DOCUMENTS

| | | | |
|---|---|---|---|
| 2010/0163571 | A1 | 7/2010 | Mizoro |
| 2012/0261874 | A1 | 10/2012 | Arikata et al. |
| 2014/0090949 | A1 | 4/2014 | Suetaka |
| 2014/0262678 | A1 | 9/2014 | Ohara et al. |

FOREIGN PATENT DOCUMENTS

| | | | | |
|---|---|---|---|---|
| JP | 2006-69708 | | 3/2006 | |
| JP | 2008-171451 | | 7/2008 | |
| JP | 2012-226494 | | 11/2012 | |
| JP | 2013-84204 | | 5/2013 | |
| JP | 2013-199365 | | 10/2013 | |
| JP | 2013-250870 | | 12/2013 | |
| WO | WO 2009/050796 | A1 | 4/2009 | |
| WO | WO-2012005088 | A1 * | 1/2012 | ..... B65H 29/006 |

OTHER PUBLICATIONS

Written Opinion of the International Searching Authority dated Jul. 12, 2016 in corresponding International Patent Application No. PCT/JP2016/065816.

* cited by examiner

PAPER SHEET ACCOMMODATION APPARATUS AND METHOD OF CONTROLLING PAPER SHEET ACCOMMODATION APPARATUS

CROSS-REFERENCE TO RELATED APPLICATION

This application is a continuation application of International Application PCT/JP2016/065816, filed on May 27, 2016 and designating the U.S., the entire contents of which are incorporated herein by reference.

FIELD

The present invention relates to a paper sheet accommodation apparatus and a method of controlling a paper sheet accommodation apparatus.

BACKGROUND

A banknote handling apparatus included in an automated teller machine (ATM) includes a banknote accommodation apparatus that temporarily accommodates deposited banknotes. As such, a kind of banknote accommodation apparatus, a configuration, in which a banknote is wound around a winding drum together with a tape supplied from a supply reel, is known.

Patent Literature 1: Japanese Laid-open Patent Application No. 2013-199365

Patent Literature 2: Japanese Laid-open Patent Application No. 2001-122470

However, in the banknote accommodation apparatus described above, a transport path, on which the banknote is transported by a transport roller, and the banknote accommodation apparatus are separated from each other, and a gap is provided between the transport path and a taking in and out section, through which the banknote is taken in and out from the banknote accommodation apparatus. Therefore, in the banknote accommodation apparatus, when a paper jam (hereinafter, referred to as jam), at which the banknote is jammed, occurs at the time of winding and unwinding of the banknote, there may be cases where the banknote stays in the gap between the transport path and the taking in and out section. In a case where the banknote stays in the gap, it is difficult to move the banknote using the transport roller of the transport path or the tape of the banknote accommodation apparatus, and it is difficult to resolve the jam. In addition, in the banknote accommodation apparatus, in a case of resolving a jam, there is a concern that an excessive force may be applied to the banknote that causes the jam or the tape may be caught in the banknote that causes the jam, thereby damaging the banknote or the tape.

SUMMARY

According to an aspect of the embodiments, a paper sheet accommodation apparatus includes: a supply reel which supplies a wound band-like material;

a winding drum around which a paper sheet is wound together with the band-like material supplied from the supply reel; a taking in and out section through which the paper sheet is taken in and out; and a rotating shaft that is disposed in the taking in and out section, is rotatably provided with a pulley that supports the band-like material, and has a transport roller fixed thereto, which transports the paper sheet.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments of a paper sheet accommodation apparatus and a method of controlling a paper sheet accommodation apparatus, disclosed in this application, will be described in detail with reference to the drawings. The paper sheet accommodation apparatus and the paper sheet accommodation method, disclosed in this application, are not limited by the following embodiments.

Embodiment

[Configuration of Banknote Handling Apparatus]

Figure 1:
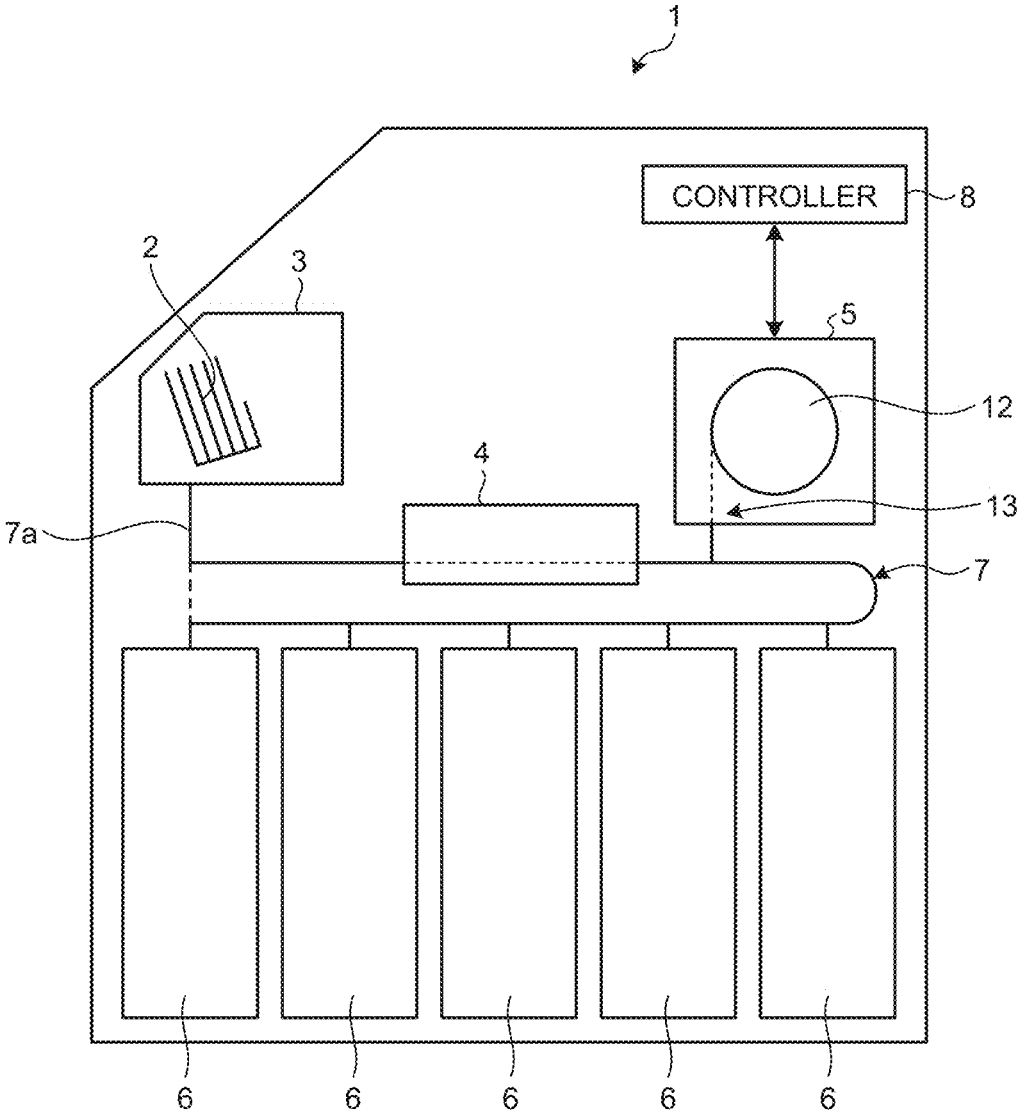
FIG. 1 is a schematic view illustrating the entirety of a banknote handling apparatus including a banknote accommodation apparatus of an embodiment.

FIG. 1 is a schematic view illustrating the entirety of a banknote handling apparatus including a banknote accommodation apparatus of an embodiment. As illustrated in FIG. 1, the banknote handling apparatus 1 according to the embodiment includes a deposit and withdrawal unit 3 for deposits and withdrawals of a banknote 2, a discriminating unit 4 which discriminates the authenticity of the banknote 2 deposited into the deposit and withdrawal unit 3, and a temporary accommodation unit 5 which temporarily accommodates the banknote 2 transported from the discriminating unit 4. In addition, the banknote handling apparatus 1 includes a plurality of storage units 6 which store the banknote 2 sent from the temporary accommodation unit 5, a transport mechanism 7 which transports the banknote 2, and a controller 8 which controls each of the units 3, 4, 5, 6, and 7. The transport mechanism 7 has a transport path 7*a* on which the banknotes 2 is transported between the units 3, 4, 5, and 6. The temporary accommodation unit 5, assembled into the banknote handling apparatus 1, corresponds to the banknote accommodation apparatus of the embodiment. In this embodiment, the banknote 2 is used as an example of paper sheets, but the paper sheet is not limited to a banknote. Examples of paper sheets include securities such as promissory notes, checks, gift certificates, various securities, and stock certificates.

[Configuration of Banknote Accommodation Apparatus]

Figure 2:
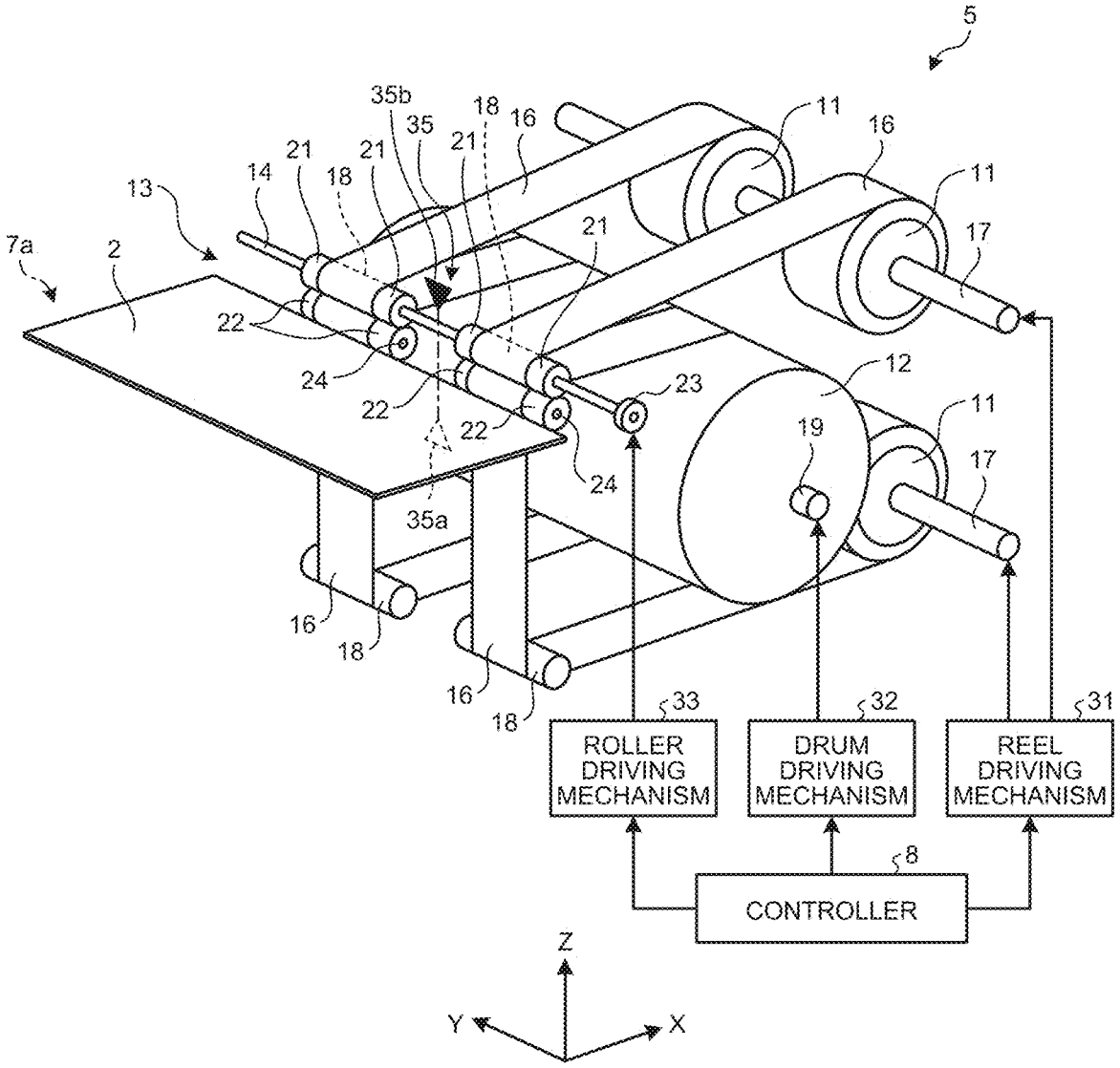
FIG. 2 is a perspective view illustrating the banknote accommodation apparatus of the embodiment.
Figure 3:
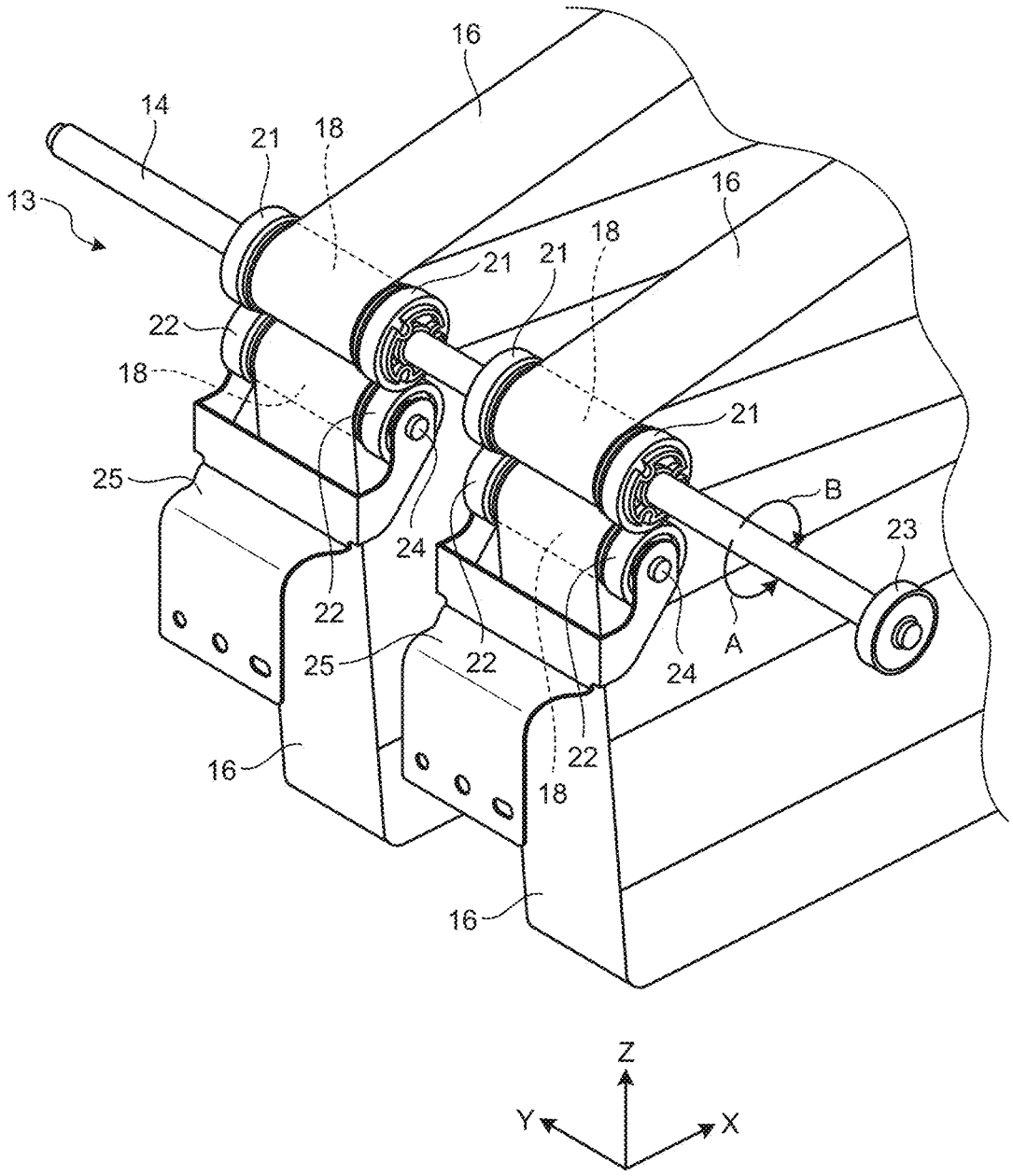
FIG. 3 is a perspective view illustrating a rotating shaft provided with pulleys and transport rollers in the banknote accommodation apparatus of the embodiment.
Figure 4:
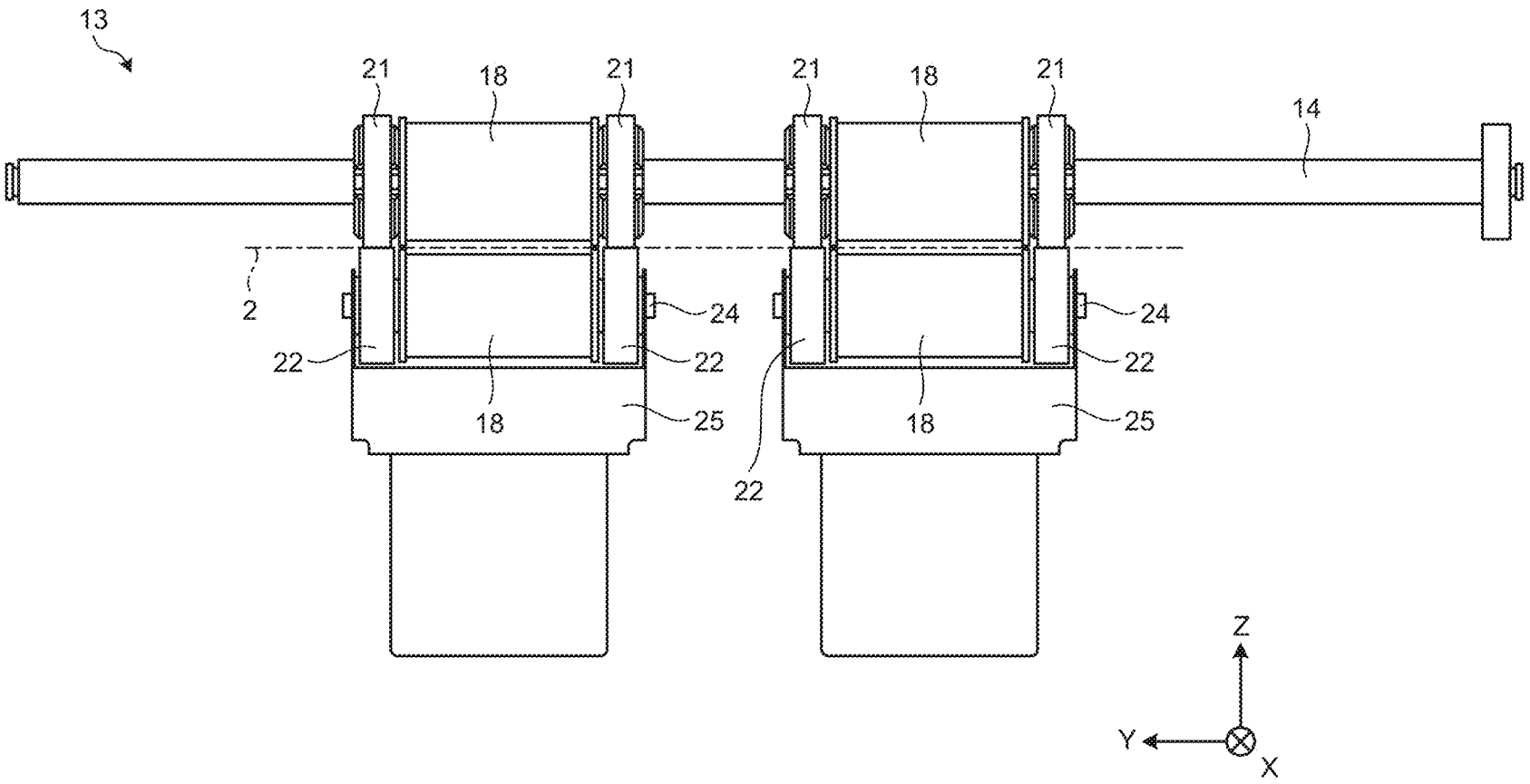
FIG. 4 is a front view illustrating the rotating shaft provided with the pulleys and the transport rollers in the banknote accommodation apparatus of the embodiment in a transport direction of a banknote.

FIG. 2 is a perspective view illustrating the banknote accommodation apparatus of the embodiment. FIG. 3 is a perspective view illustrating a rotating shaft provided with pulleys and transport rollers in the banknote accommodation apparatus of the embodiment. FIG. 4 is a front view illustrating the rotating shaft provided with the pulleys and the transport rollers in the banknote accommodation apparatus of the embodiment in a transport direction of the banknote.

As illustrated in FIG. 2, the banknote accommodation apparatus 5 of the embodiment includes two sets of supply reels 11, a winding drum 12, a taking in and out section 13, a rotating shaft 14. In FIG. 2, for convenience of description, the direction, in which the banknote 2 enters and leaves the taking in and out section 13, is referred to as an X direction, the axial direction of the winding drum 12 is referred to as a Y direction, and the vertical direction of the banknote accommodation apparatus 5 illustrated in FIG. 2, is referred to as a Z direction. In FIG. 3 and the following figures, similarly to FIG. 2, the X, Y, and Z directions are illustrated.

Each of the supply reels 11 supplies a tape 16 as a wound band-like material. In the two sets of supply reels 11, the two supply reels 11, which are disposed below the winding drum 12, are supported on a common reel shaft 17, and are disposed with a predetermined interval therebetween in the axial direction of the winding drum 12. Similarly, the two supply reels 11 disposed above the winding drum 12 are supported on a common reel shaft 17 and are disposed with a predetermined interval therebetween in the axial direction of the winding drum 12. A traveling path of the tape 16 is formed between each of the supply reels 11 and the winding drum 12, and a plurality of pulleys 18 are disposed on the traveling path of the tape 16. Each of the pulleys 18 are rotatably supported by a support shaft and the like, and supports the tape 16 so as to move along the traveling path. In addition, each of the supply reels 11 is supported on the reel shaft 17 via a torque limiter (not illustrated), and the tension generated in the tape 16 is limited to a predetermined tension or less.

The winding drum 12 is supported by a support shaft 19. The banknote 2 is wound around the winding drum 12 together with the tape 16 supplied from each of the supply reels 11. Specifically, in a state in which the banknotes 2 are held between the tapes 16 by interposing the banknotes 2 between the two tapes 16, sent through the upper side of the winding drum 12, and the two tapes 16, sent through the lower side of the winding drum 12, the banknotes 2 are wound around the winding drum 12 together with the tapes 16.

As illustrated in FIG. 1, the taking in and out section 13 is provided adjacent to the transport path 7*a*, and the banknote 2 is taken in and out between the transport path 7*a* and the banknote accommodation apparatus 5. The rotating shaft 14 is disposed in the taking in and out section 13, and a plurality of pulleys 18, which support the tapes 16, are rotatably provided, and a plurality of transport rollers 21, which transport the banknotes 2 relative to the winding drum 12, are fixed. In addition, a drive transmission member 23 such as a pulley, on which a driving belt is hung, is fixed to one end of the rotating shaft 14 in order to cause the rotating shaft 14 to be driven to rotate by a roller driving mechanism 33, which will be described later.

The pulley 18 is rotatably supported on the rotating shaft 14 via a bearing member (not illustrated) such as a bearing. The transport rollers 21 are disposed adjacent to both sides of the pulley 18 in the axial direction (Y direction) of the rotating shaft 14. The diameter of the transport roller 21 is set to be slightly larger than the diameter of the pulley 18, for example. As the transport roller 21, for example, a rubber roller is used.

In the taking in and out section 13, as illustrated in FIGS. 3 and 4, a pulley 18 and a driven roller 22 are provided to be respectively paired with each of the pulleys 18 and each of the transport rollers 21, which are supported on the rotating shaft 14 at facing positions in the Z directions. The pulley 18 and the driven roller 22 are rotatably supported by a support shafts 24 via bearing members (not illustrated) such as bearings. A support stay 25 is fixed in the vicinity of the taking in and out section 13, and both ends of the support shaft 24 are supported by the support stay 25. The driven roller 22 rotates along with the transport roller 21 as the transport roller 21 rotates.

In addition, as illustrated in FIG. 3, in a case where the banknote 2, which is taken in from the taking in and out section 13, is wound around the winding drum 12, the rotating shaft 14 rotates in an A direction such that the transport roller 21 is rotated in the direction, in which the banknote 2 is wound around the winding drum 12. On the other hand, in a case where the banknote 2, which is wound around the winding drum 12, is taken out of the taking in and out section 13, the rotating shaft 14 rotates in a B direction such that the transport roller 21 is rotated in the direction, in which the banknote 2 is unwound around the winding drum 12 (hereinafter, referred to as unwinding direction).

In the embodiment, the banknote accommodation apparatus 5 is configured to include only a single rotating shaft 14, provided with the pulleys 18 and the transport rollers 21, but may also be configured to include two rotating shafts so that the rotating shafts 14, provided with the pulleys 18 and the transport rollers 21, form a pair. In addition, in the embodiment, the rotating shaft 14, which supports the transport rollers 21, is disposed at a higher position in the vertical direction (Z direction), and the support stay 25, which supports the driven rollers 22, is disposed at a lower position. However, the rotating shaft 14 and the support stay 25 are not limited to this configuration, and may be disposed reversely in the vertical direction.

In addition, in the embodiment, the tape 16, which is narrow, is used as an example of the band-like material, but the band-like material is not limited to the tape. In addition, in the embodiment, the tape 16 made of a resin film is used but is not limited thereto, and as appropriate, a tape made of another material can also be used.

As illustrated in FIG. 2, the banknote accommodation apparatus 5 includes a reel driving mechanism 31 which drives the supply reels 11 to rotate, a drum driving mechanism 32 which drives the winding drum 12 to rotate, and the roller driving mechanism 33 which drives the transport roller 21 to rotate via the rotating shaft 14. Each of the reel driving mechanism 31, the drum driving mechanism 32, and the roller driving mechanism 33 is electrically connected to the controller 8. The reel driving mechanism 31 and the drum driving mechanism 32 have different rotational speeds, and perform a winding operation and an unwinding operation in a state where a constant tension is applied to the tape 16.

Furthermore, the roller driving mechanism 33 is driven in conjunction with the transport mechanism 7 that drives the transport path 7*a*. In this embodiment, the reel driving mechanism 31 and the roller driving mechanism 33 are driven by a common driving motor (not illustrated), and are configured to be reversibly rotatable individually via a switching gear or the like. The embodiment is not limited to this configuration, and the reel driving mechanism 31 and the roller driving mechanism 33 may be separately driven by independent driving motors. Furthermore, the roller driving mechanism 33 may be driven by a driving motor that drives the transport mechanism 7.

Furthermore, the banknote accommodation apparatus 5 includes a position sensor 35 as a detector that detects the banknote 2. The position sensor 35 is disposed in the vicinity of the rotating shaft 14, and detects the banknote 2 that passes through the taking in and out section 13. The position sensor 35 is connected to the controller 8. The controller 8 controls the reel driving mechanism 31, the drum driving mechanism 32, and the roller driving mechanism 33 based on the detection result of the position sensor 35.

Figure 5A:
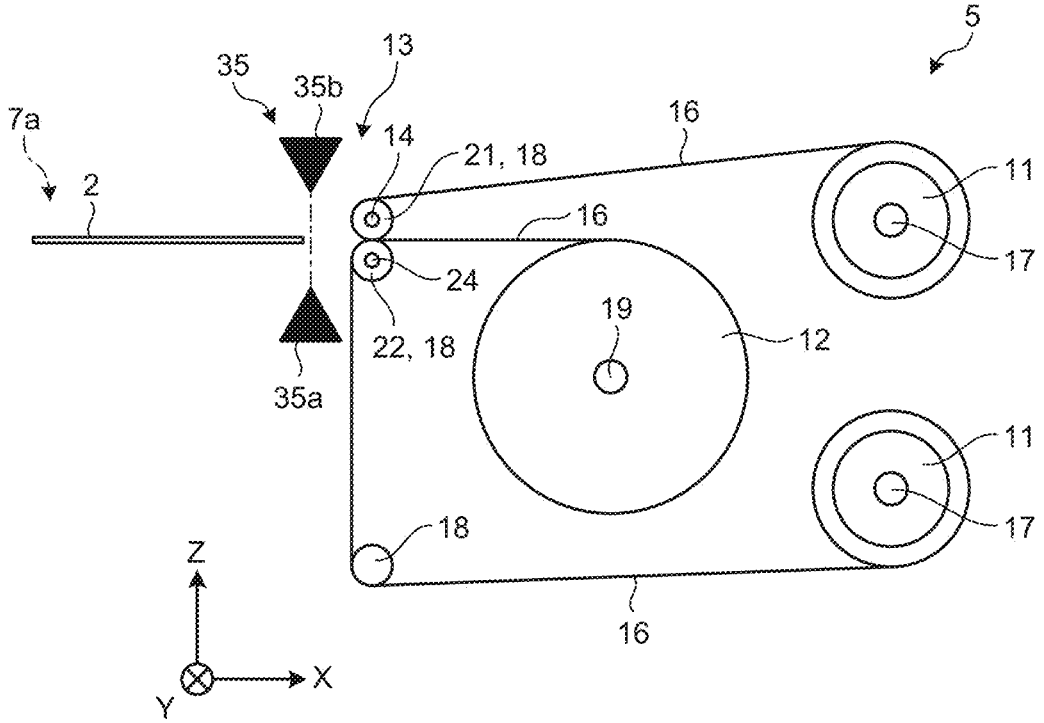
FIG. 5A is a side view schematically illustrating an initial state of a winding drum of the banknote accommodation apparatus of the embodiment.
Figure 5B:
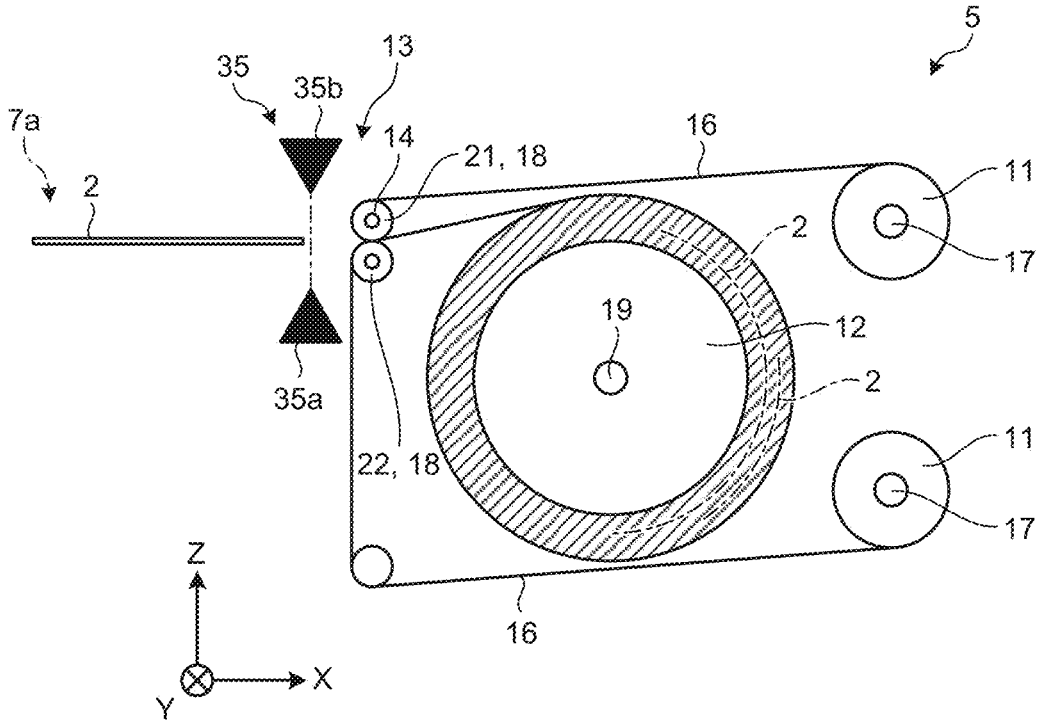
FIG. 5B is a side view schematically illustrating a state in which the banknote is wound around the winding drum of the banknote accommodation apparatus of the embodiment.

In the embodiment, the position sensor 35 is disposed in the vicinity of the taking in and out section 13 that the banknote 2 enters and leaves with respect to the banknote accommodation apparatus 5. For example, as illustrated in FIGS. 2, 5A, and 5B, the position sensor 35 includes a light emitting unit 35*a* which emits detection light, and a light receiving unit 35*b* which receives the detection light emitted by the light emitting unit 35*a*.

In the embodiment, the light emitting unit 35*a* and the light receiving unit 35*b* are disposed to face each other in the thickness direction (Z direction) of the banknote 2 that passes through the taking in and out section 13, but are not limited to this configuration. For example, the light emitting unit 35*a* and the light receiving unit 35*b* may be disposed on the same plane along the transport direction of the banknote 2. In a case of this configuration, each of the light emitting unit 35*a* and the light receiving unit 35*b* may be disposed on one side in the thickness direction of the banknote 2 that passes through the taking in and out section 13, and on the other side in the thickness direction of the banknote 2, an optical member (not illustrated), which reflects and guides the detection light emitted by the light emitting unit 35*a* to cause the detection light to be reflected on the light receiving unit 35*b*, may be disposed.

In addition, the position sensor 35 is disposed on the opposite side of the rotating shaft 14 from the winding drum 12, that is, on the transport path 7*a* side on which the banknote 2 is transported toward the banknote accommodation apparatus 5, but may also be disposed on the winding drum 12 side from the rotating shaft 14, that is, inside the banknote accommodation apparatus 5.

In a case where the banknote 2 is not detected by the position sensor 35 when a predetermined time has elapsed since the start of an operation of unwinding the banknote 2 from the winding drum 12 or an operation of winding the banknote 2 around the winding drum 12, and in a case where the detection state of the banknote 2, detected by the position sensor 35, continues for a predetermined time, the controller 8 determines that a jam of the banknote 2 has occurred. In a case where the controller 8 determines that a jam of the banknote 2 has occurred, the controller 8 drives either one of the transport roller 21 and the pulley 18 to rotate around the rotating shaft 14 by controlling the reel driving mechanism 31, the drum driving mechanism 32, and the roller driving mechanism 33.

That is, by driving the reel driving mechanism 31 and the drum driving mechanism 32 by the controller 8, the tape 16 is sent in the direction, in which the tape 16 is wound around the winding drum 12 (winding direction), or in the direction, in which the tape 16 wound around the winding drum 12 is unwound (unwinding direction), and the pulley 18 rotates around the rotating shaft 14 together with the tape 16. In addition, by driving the roller driving mechanism 33 by the controller 8, the banknote 2 is sent in the direction, in which the banknote 2 is wound around the winding drum 12 (winding direction), or in the direction, in which the banknote 2 wound around the winding drum 12 is unwound (unwinding direction), so that the transport roller 21 is rotated together with the rotating shaft 14.

In addition, the banknote accommodation apparatus 5 of this embodiment is configured such that the banknote 2 is wound around the winding drum 12 by using the tapes 16, supplied from the two sets of upper and lower supply reels 11, which are arranged in the axial direction of the winding drum 12, but does not limit the number of tapes 16. The banknote accommodation apparatus 5 may be configured such that the banknote 2 is wound around the winding drum 12 by using the tapes 16, supplied from a set of upper and lower supply reels 11.

[Banknote Accommodation Operation]

FIG. 5A is a side view schematically illustrating an initial state of the winding drum 12 of the banknote accommodation apparatus 5 of the embodiment. FIG. 5B is a side view schematically illustrating a state in which the banknote 2 is wound around the winding drum 12 of the banknote accommodation apparatus 5 of the embodiment.

In the banknote accommodation apparatus 5, as the banknote 2 is wound around the winding drum 12 together with the tape 16 from the initial state, in which the banknote 2 is not wound around the winding drum 12 as illustrated in FIG. 5A, the diameter of the entire winding drum 12 gradually increases as illustrated in FIG. 5B. As illustrated in FIG. 5A, the banknote 2, which is taken in from the transport path 7*a* to the taking in and out section 13 of the banknote accommodation apparatus 5, is nipped between the transport roller 21, fixed to the rotating shaft 14, and the driven roller 22, supported by the support shaft 24 of the support stay 25, and is sent while passing through the position sensor 35. The banknote 2, which is sent by the transport roller 21 and the driven roller 22, is interposed between the tapes 16 respectively supplied from the supply reels 11 and is sent, and is accommodated along the circumferential direction of the winding drum 12 together with the tapes 16.

[Operation of Resolving Jam]

Figure 6:
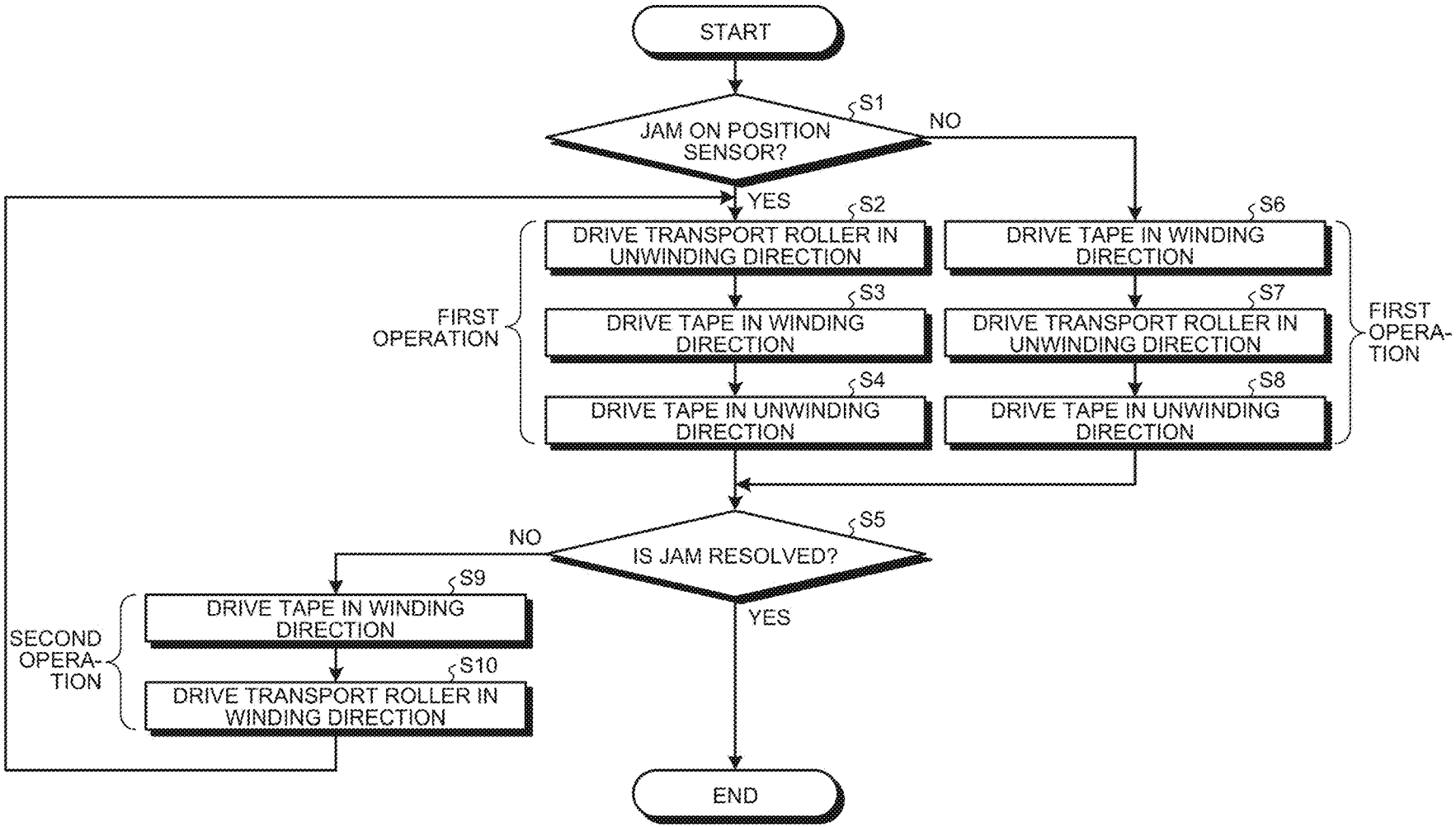
FIG. 6 is a flowchart for describing an operation of resolving a jam that has occurred at the time of unwinding the banknote in the banknote accommodation apparatus of the embodiment.
Figure 7:
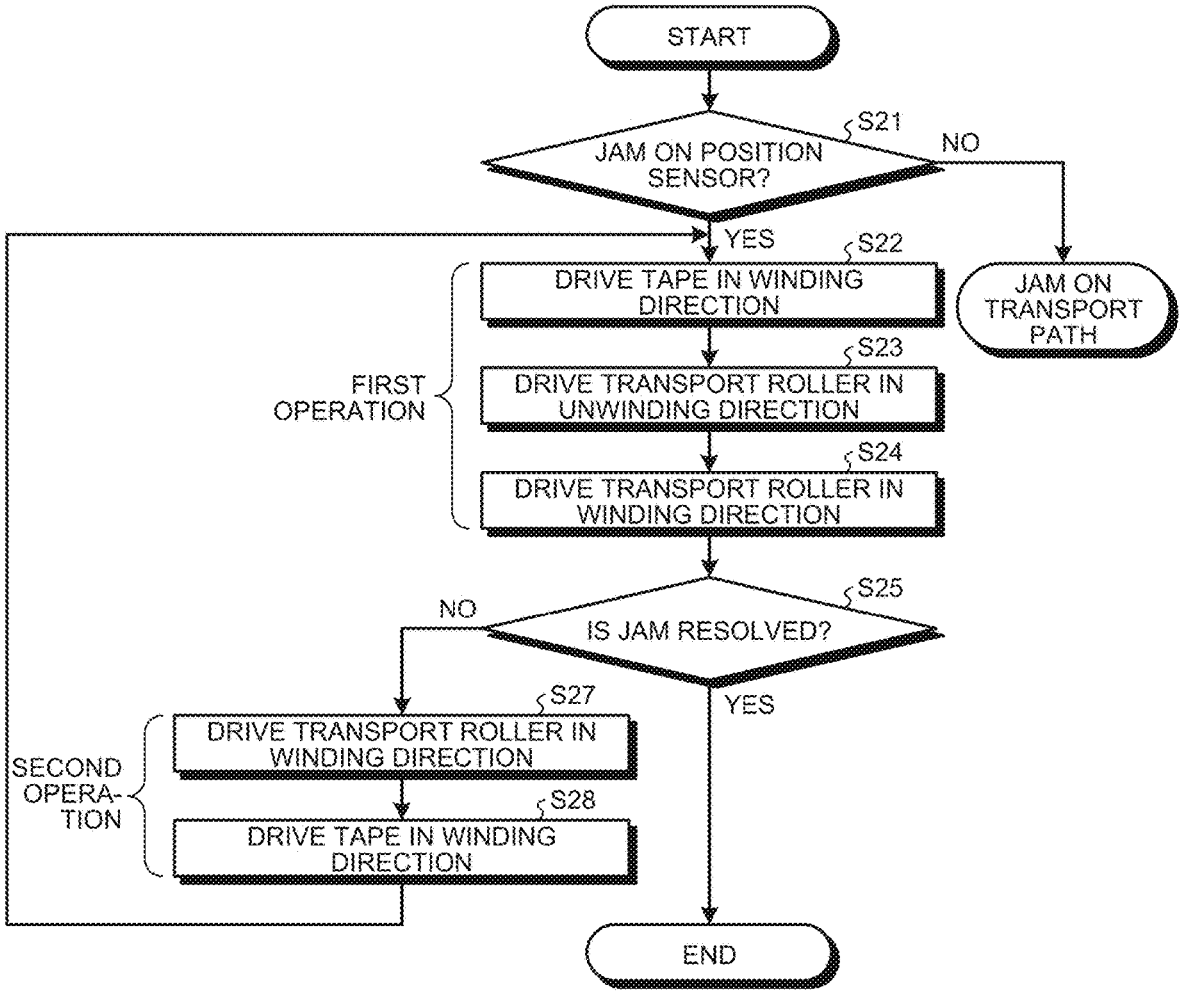
FIG. 7 is a flowchart for describing an operation of resolving a jam that has occurred at the time of winding the banknote in the banknote accommodation apparatus of the embodiment.

FIG. 6 is a flowchart for describing an operation of resolving a jam that has occurred at the time of unwinding the banknote 2 in the banknote accommodation apparatus 5 of the embodiment. FIG. 7 is a flowchart for describing an operation of resolving a jam that has occurred at the time of winding the banknote 2 in the banknote accommodation apparatus 5 of the embodiment.

As described above, the controller 8 determines whether or not a jam of the banknote 2 has occurred based on the detection result of the position sensor 35. In a case where the controller 8 determines that a jam of the banknote 2 has occurred, the controller 8 starts an operation of resolving a jam by driving either one of the transport roller 21 and the pulley 18 to rotate around the rotating shaft 14. First, a case where a jam has occurred when the banknote 2, which is wound around the winding drum 12, is unwound from the banknote accommodation apparatus 5, will be described.

In a case where the controller 8 determines that a jam of the banknote 2 has occurred, as illustrated in FIG. 6, the controller 8 determines whether or not the detection state of the banknote 2, detected by the position sensor 35, continues, that is, a jam has occurred on the position sensor 35 (Step S1). When the controller 8 determines that a jam has occurred on the position sensor 35, the controller 8 drives the rotating shaft 14 to rotate in the B direction (see FIG. 3) using the roller driving mechanism 33 such that the transport roller 21 is driven to rotate in the unwinding direction (Step S2).

When a jam has occurred at the time of unwinding the banknote 2, it is preferable that the banknote 2 in the transport path 7*a* is transported while avoiding the return of the banknote 2 normally unwound to the transport path 7*a* to the banknote accommodation apparatus 5. Therefore, in a case where a jam has occurred on the position sensor 35 at the time of unwinding the banknote 2, that is, a jam has occurred in the vicinity of the taking in and out section 13, as illustrated in Step S2, the transport roller 21 is temporarily rotated in the unwinding direction.

Subsequently, the controller 8 drives the tape 16 in the winding direction using the reel driving mechanism 31 and the drum driving mechanism 32 (Step S3). Accordingly, the controller 8 rotates the pulley 18 together with the tape 16 in the A direction (see FIG. 3) around the rotating shaft 14. At this time, the pulley 18 is rotated in a direction opposite to the rotational direction of the transport roller 21 in Step S2.

Subsequently, the controller 8 drives the tape 16 in the unwinding direction using the reel driving mechanism 31 and the drum driving mechanism 32 (Step S4). Accordingly, the controller 8 rotates the pulley 18 together with the tape 16 in the B direction (see FIG. 3) around the rotating shaft 14. Therefore, the pulley 18 is rotated in a direction opposite to the rotational direction of the pulley 18 in Step S3.

In a case where a jam has occurred on the position sensor 35 at the time of unwinding the banknote 2 as described above, as a first operation for resolving the jam, in Steps S2 to S4 in FIG. 6, the controller 8 drives the transport roller 21 and the pulley 18 (the tape 16) to be alternately rotated in opposite directions. The controller 8 makes a change in the banknote 2 that causes the jam, and resolves the jam by applying different external forces to the banknote 2 that causes the jam in the vicinity of the taking in and out section 13 by performing the first operation. After performing the first operation in Steps S2 to S4, the controller 8 determines whether or not the jam has been resolved (Step S5).

On the other hand, in Step S1 described above, when the controller 8 determines that no jam has occurred on the position sensor 35, the controller 8 drives the tape 16 in the winding direction using the reel driving mechanism 31 and the drum driving mechanism 32 (Step S6). Accordingly, the controller 8 rotates the pulley 18 together with the tape 16 in the A direction (see FIG. 3) around the rotating shaft 14.

In a case where no jam has occurred on the position sensor 35 as described above and a jam has occurred in the periphery of the winding drum 12, it is preferable to resolve slack of the tape 16. Therefore, in a case where no jam has occurred on the position sensor 35 at the time of unwinding the banknote 2, that is, in a case where a jam has occurred in the periphery of the winding drum 12, the controller 8 temporarily drives the tape 16 in the winding direction.

Subsequently, the controller 8 drives the rotating shaft 14 to rotate in the B direction (see FIG. 3) using the roller driving mechanism 33 such that the transport roller 21 is driven to rotate in the unwinding direction (Step S7). At this time, the transport roller 21 is rotated in a direction opposite to the rotational direction of the pulley 18 in Step S6.

Subsequently, the controller 8 drives the tape 16 in the unwinding direction using the reel driving mechanism 31 and the drum driving mechanism 32 (Step S8). Accordingly, the controller 8 rotates the pulley 18 together with the tape 16 in the B direction (see FIG. 3) around the rotating shaft 14. Therefore, the pulley 18 is rotated in a direction opposite to the rotational direction of the pulley 18 in Step S6.

In a case where no jam has occurred on the position sensor 35 at the time of unwinding the banknote 2 as described above, as a first operation for resolving the jam, in Steps S6 to S8 in FIG. 6, the controller 8 drives the transport roller 21 and the pulley 18 (the tape 16) to be alternately rotated in opposite directions. The controller 8 resolves the jam by applying different external forces to the banknote 2, which causes the jam in the periphery of the winding drum 12, by performing the first operation. After performing the first operation in Steps S6 to S8, the controller 8 determines whether or not the jam has been resolved (Step S5).

In Step S5 described above, when the controller 8 determines that the jam has been resolved, the controller 8 ends the operation of resolving a jam. On the other hand, when the controller 8 determines that the jam has not been resolved based on the detection result of the position sensor 35, the controller 8 drives the tape 16 in the winding direction using the reel driving mechanism 31 and the drum driving mechanism 32 (Step S9). Accordingly, the controller 8 rotates the pulley 18 together with the tape 16 in the A direction (see FIG. 3) around the rotating shaft 14.

Subsequently, the controller 8 drives the rotating shaft 14 to rotate in the A direction (see FIG. 3) using the roller driving mechanism 33 such that the transport roller 21 is driven to rotate in the winding direction (Step S10). At this time, the transport roller 21 is rotated in the same direction as the rotational direction of the pulley 18 in Step S9.

In a case where the jam, which has occurred at the time of unwinding the banknote 2, has not been resolved after the first operation, as a second operation for resolving the jam, in Steps S9 and S10 in FIG. 6, the controller 8 drives the transport roller 21 and the pulley 18 (the tape 16) to be alternately rotated in the same direction. The controller 8 makes a change in the banknote 2 and resolves the jam by applying different external forces to the banknote 2, which causes the jam, by performing the second operation. That is, in a case where the jam, which has occurred at the time of unwinding the banknote 2, has not been resolved by the first operation, the controller 8 resolves the jam by performing the operation of winding the banknote 2 around the winding drum 12 as the second operation.

After performing the second operation in Steps S9 and S10, the controller 8 transitions to Step S2 and repeats the first operation again. Thereafter, in Step S5, the controller 8 alternately repeats the first operation and the second operation until the controller 8 determines that the jam has been resolved.

After repeating the first operation and the second operation a predetermined number of times, in a case where the controller 8 does not determine that the jam has been resolved, that is, in a case where the jam has not been resolved, the controller 8 may perform control so as to end the operation of resolving a jam. After the second operation, the controller 8 may determine whether or not the jam has been resolved, and may perform control so as to repeat the first operation only in a case where the jam has not been resolved.

Next, a case where a jam occurs at the time of winding the banknote 2 around the winding drum 12 when the banknote 2 is accommodated in the banknote accommodation apparatus 5, will be described. In a case where the controller 8 determines that a jam of the banknote 2 has occurred, as illustrated in FIG. 7, the controller 8 determines whether or not the detection state of the banknote 2, detected by the position sensor 35, continues, that is, a jam has occurred on the position sensor 35 (Step S21).

When the controller 8 determines that a jam has occurred on the position sensor 35, the controller 8 drives the tape 16 in the winding direction using the reel driving mechanism 31 and the drum driving mechanism 32 (Step S22). Accordingly, the controller 8 rotates the pulley 18 together with the tape 16 in the A direction (see FIG. 3) around the rotating shaft 14. Accordingly, slack of the tape 16 is resolved.

Subsequently, the controller 8 drives the rotating shaft 14 to rotate in the B direction (see FIG. 3) using the roller driving mechanism 33 such that the transport roller 21 is driven to rotate in the unwinding direction (Step S23). At this time, the transport roller 21 is rotated in a direction opposite to the rotational direction of the pulley 18 in Step S22.

When a jam has occurred at the time of winding the banknote 2, there is a high possibility, in which a space for returning the banknote 2 may remain in the transport path 7*a* up to the taking in and out section 13, and it is preferable to return the banknote 2, which causes the jam on the position sensor 35, to the transport path 7*a* side from the taking in and out section 13. Therefore, the controller 8 temporarily rotates the transport roller 21 in the unwinding direction as described in Step S23.

Subsequently, the controller 8 drives the rotating shaft 14 to rotate in the A direction (see FIG. 3) using the roller driving mechanism 33 such that the transport roller 21 is driven to rotate in the winding direction (Step S24). Accordingly, the controller 8 winds the banknote 2 that causes the jam around the winding drum 12. Therefore, the transport roller 21 is rotated in a direction opposite to the rotational direction of the transport roller 21 in Step S23.

In a case where a jam has occurred on the position sensor 35 at the time of winding the banknote 2 as described above, as a first operation for resolving the jam, in Steps S22 to S24 in FIG. 7, the controller 8 drives the transport roller 21 and the pulley 18 (the tape 16) to be alternately rotated in opposite directions. The controller 8 makes a change in the banknote 2 and resolves the jam by applying different external forces to the banknote 2, which causes the jam in the vicinity of the taking in and out section 13, by performing the first operation. After performing the first operation in Steps S22 to S24, the controller 8 determines whether or not the jam has been resolved (Step S25).

On the other hand, in Step S21 described above, when the controller 8 determines that no jam has occurred on the position sensor 35, a jam has occurred on the transport path 7*a* on which the banknote 2 is transported to the taking in and out section 13 of the banknote accommodation apparatus 5. Therefore, in the banknote accommodation apparatus 5, the operation of resolving a jam is not performed, and an operation of resolving the jam, which has occurred on the transport path 7*a*, due to the transport mechanism 7, is performed.

In Step S25 described above, when the controller 8 determines that the jam has been resolved, the controller 8 ends the operation of resolving a jam. On the other hand, when the controller 8 determines that the jam has not been resolved based on the detection result of the position sensor 35, the controller 8 drives the rotating shaft 14 to rotate in the B direction (see FIG. 3) using the roller driving mechanism 33 such that the transport roller 21 is driven to rotate in the unwinding direction (Step S27).

Subsequently, the controller 8 drives the tape 16 in the unwinding direction using the reel driving mechanism 31 and the drum driving mechanism 32 (Step S28). Accordingly, the controller 8 rotates the pulley 18 together with the tape 16 in the B direction (see FIG. 3) around the rotating shaft 14. At this time, the pulley 18 is rotated in the same direction as the rotational direction of the transport roller 21 in Step S27.

In a case where the jam, which has occurred at the time of winding the banknote 2, has not been resolved after the first operation, as a second operation for resolving the jam, in Steps S27 and S28 in FIG. 7, the controller 8 drives the transport roller 21 and the pulley 18 (the tape 16) to be alternately rotated in the same direction. The controller 8 makes a change in the banknote 2 and resolves the jam by applying different external forces to the banknote 2, which causes the jam, by performing the second operation. That is, in a case where the jam, which has occurred at the time of winding the banknote 2, has not been resolved by the first operation, the controller 8 resolves the jam by performing the operation of unwinding the banknote 2 from the winding drum 12 as the second operation.

After performing the second operation in Steps S27 and S28, the controller 8 transitions to Step S22 and repeats the first operation again. Thereafter, in Step S25, the controller 8 alternately repeats the first operation and the second operation until the controller 8 determines that the jam has been resolved.

Even in the operation of resolving the jam at the time of winding the banknote 2, after repeating the first operation and the second operation a predetermined number of times, in a case where the controller 8 does not determine that the jam has been resolved, that is, in a case where the jam has not been resolved, the controller 8 may perform control so as to end the operation of resolving a jam. After the second operation, the controller 8 may determine whether or not the jam has been resolved, and may perform control so as to repeat the first operation only in a case where the jam has not been resolved.

[Method of Controlling Banknote Accommodation Apparatus]

In a method of controlling the banknote accommodation apparatus 5 configured as described above, the rotating shaft 14 which is disposed in the taking in and out section 13, through which the banknote 2 is taken in and out from the banknote accommodation apparatus 5, is rotatably provided with the pulley 18 that supports the tape 16 supplied from the supply reel 11, and has the transport roller 21 fixed thereto, which transports the banknote 2 with respect to the winding drum 12 around which the banknote 2 together with the tape 16 is wound. In this controlling method, in a case where the banknote 2 is not detected by the position sensor 35 that detects the banknote 2 when a predetermined time has elapsed since the start of the operation of unwinding the banknote 2 from the winding drum 12 or the operation of winding the banknote 2 around the winding drum 12, and in a case where the detection state of the banknote 2, detected by the position sensor 35, continues for a predetermined time, either one of the transport roller 21 and the pulley 18 is driven to rotate around the rotating shaft 14.

The banknote accommodation apparatus 5 of the embodiment includes the rotating shaft 14 disposed in the taking in and out section 13, the rotating shaft 14 is rotatably provided with the pulley 18 that supports the tape 16, and has the transport roller 21 fixed thereto, which transports the banknote 2. Accordingly, the generation of a gap in which the banknote 2 is not easily transported, that is, a range, in which the banknote 2 does not reach the transport roller 21 at the connection portion between the transport path 7*a* of the transport mechanism 7 and the banknote accommodation apparatus 5 as in the related art, can be avoided. In addition, in the banknote accommodation apparatus 5, since the transport roller 21 and the pulley 18 can be driven to rotate each independently around the rotating shaft 14, the transport roller 21 and the pulley 18 can be rotated in opposite directions, so that it becomes easy to make a change in the banknote 2 in the jammed state. As a result, the banknote accommodation apparatus 5 has a higher possibility of resolving a jam that has occurred at the time of unwinding and at the time of winding the banknote 2, so that the reliability of the operation of resolving a jam can be increased.

In addition, the banknote accommodation apparatus 5 in the embodiment includes the controller 8 that controls the reel driving mechanism 31, the drum driving mechanism 32, and the roller driving mechanism 33 based on the detection result of the position sensor 35. In a case where the banknote 2 is not detected by the position sensor 35 when a predetermined time has elapsed since the start of an operation of unwinding the banknote 2 from the winding drum 12 or an operation of winding the banknote 2 around the winding drum 12, and in a case where the detection state of the banknote 2 detected by the position sensor 35 continues for a predetermined time, the controller 8 drives either one of the transport roller 21 and the pulley 18 to rotate around the rotating shaft 14 by controlling the reel driving mechanism 31, the drum driving mechanism 32, and the roller driving mechanism 33. Accordingly, a change is made in the banknote 2 in the jammed state, so that the jam can be smoothly resolved.

In addition, the controller 8 included in the banknote accommodation apparatus 5 performs the first operation of driving the transport roller 21 and the pulley 18 to alternatively rotate in opposite directions. Accordingly, it becomes possible to effectively make a change in the banknote 2 in the jammed state, and the jam can be smoothly resolved.

Furthermore, in the first operation, the controller 8, included in the banknote accommodation apparatus 5, drives the transport roller 21 and the pulley 18 to alternately rotate in opposite directions, and thereafter drives either one of the transport roller 21 and the pulley 18 to rotate in the direction opposite to the rotational direction in which the transport roller 21 and the pulley 18 are driven to rotate in the opposite directions. Accordingly, it becomes possible to effectively make a change in the banknote 2 in the jammed state, so that the jam can be smoothly resolved.

In addition, in a case where the detection state of the banknote 2, detected by the position sensor 35, continues after the first operation, the controller 8 included in the banknote accommodation apparatus 5 performs the second operation of driving the transport roller 21 and the pulley 18 to alternately rotate in the same direction. Accordingly, even in a case where the jam has not been resolved in the first operation, it is possible to effectively make a change in the banknote 2 in the jammed state, so that the jam can be smoothly resolved.

In addition, in the banknote accommodation apparatus 5, by the controller 8, in the first operation, the transport roller 21 is driven to rotate in the direction in which the banknote 2 is unwound from the winding drum 12, and the pulley 18 is driven to rotate in the direction in which the tape 16 is wound around the winding drum 12, by the controller 8. Accordingly, the banknote 2 is unwound from the winding drum 12, and slack of the tape 16 in the periphery of the winding drum 12 is resolved, so that the jam, which has occurred in the periphery of the winding drum 12, can be smoothly resolved.

In addition, the controller 8 included in the banknote accommodation apparatus 5 performs the first operation again after the second operation. Accordingly, a change in the banknote 2 in the jammed state is repeatedly made, and thus the probability of resolving the jam can be increased, so that it is possible to increase the reliability of the operation of resolving a jam.

According to the aspect of the paper sheet accommodation apparatus disclosed in this application, the reliability of an operation of resolving a jam of a paper sheet can be increased.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet accommodation apparatus comprising:

a supply reel which supplies a wound band-like material;

a winding drum around which a paper sheet is wound together with the band-like material supplied from the supply reel;

a taking in and out section through which the paper sheet is taken in and out;

a rotating shaft that is disposed in the taking in and out section, is rotatably provided with a pulley that supports the band-like material, and has a transport roller fixed thereto, which transports the paper sheet;

a reel driving mechanism which drives the supply reel to rotate;

a drum driving mechanism which drives the winding drum to rotate;

a roller driving mechanism which drives the transport roller to rotate via the rotating shaft;

a detector which is disposed in the vicinity of the rotating shaft and detects the paper sheet; and a controller which controls the reel driving mechanism, the drum driving mechanism, and the roller driving mechanism based on a detection result of the detector, wherein, in a case where the paper sheet is not detected by the detector when a predetermined time has elapsed since the start of an operation of unwinding the paper sheet from the winding drum or an operation of winding the paper sheet around the winding drum, and in a case where a detection state of the paper sheet, detected by the detector, continues for a predetermined time, the controller drives either one of the transport roller and the pulley to rotate around the rotating shaft by controlling the reel driving mechanism, the drum driving mechanism, and the roller driving mechanism.

2. The paper sheet accommodation apparatus according to claim 1, wherein the controller performs a first operation of driving the transport roller and the pulley to alternately rotate in opposite directions.

3. The paper sheet accommodation apparatus according to claim 2, wherein, in the first operation, the controller drives the transport roller and the pulley to alternately rotate in the opposite directions, and thereafter drives either one of the transport roller and the pulley to rotate in a direction opposite to a rotational direction in which the transport roller and the pulley are driven to rotate in the opposite directions.

4. The paper sheet accommodation apparatus according to claim 2, wherein, in the first operation, the transport roller is driven to rotate in a direction in which the paper sheet is unwound from the winding drum, and the pulley is driven to rotate in a direction in which the band-like material is wound around the winding drum.

5. The paper sheet accommodation apparatus according to claim 3, wherein, in a case where the detection state of the paper sheet, detected by the detector, continues after the first operation, the controller performs a second operation of driving the transport roller and the pulley to alternately rotate in the same direction.

6. The paper sheet accommodation apparatus according to claim 5, wherein the controller performs the first operation again after the second operation.

7. A method of controlling a paper sheet accommodation apparatus, comprising:

using a rotating shaft that is disposed in a taking in and out section through which a paper sheet is taken in and out from a banknote accommodation apparatus, is rotatably provided with a pulley that supports a band-like material supplied from a supply reel, and has a transport roller fixed thereto, which transports the paper sheet with respect to a winding drum around which the paper sheet together with the band-like material is wound; and driving either one of the transport roller and the pulley to rotate around the rotating shaft in a case where the paper sheet is not detected by a detector that detects the paper sheet when a predetermined time has elapsed since the start of an operation of unwinding the paper sheet from the winding drum or an operation of winding the paper sheet around the winding drum, and in a case where a detection state of the paper sheet, detected by the detector, continues for a predetermined time.

* * * * *